US007543763B1

(12) United States Patent
Wu

(10) Patent No.: US 7,543,763 B1
(45) Date of Patent: Jun. 9, 2009

(54) WATER VOLUME CONTROL DEVICE FOR SHOWER HEAD

(76) Inventor: Alex Wu, No. 15, Lane 160, Fongfu Rd., Taichung (TW)

( * ) Notice: Subject to any disclaimer, the term of this patent is extended or adjusted under 35 U.S.C. 154(b) by 117 days.

(21) Appl. No.: 11/893,522

(22) Filed: Aug. 16, 2007

(51) Int. Cl.
*B05B 1/14* (2006.01)

(52) U.S. Cl. ..... 239/590.5; 239/530; 239/533.1; 239/548; 239/570; 239/590; 239/DIG. 4; 138/45; 138/46

(58) Field of Classification Search ..... 239/525, 239/530, 533.1, 548, 552, 570, 575, 590–590.5, 239/DIG. 4; 138/44–46; 137/504, 801
See application file for complete search history.

(56) References Cited

U.S. PATENT DOCUMENTS 3,999,714 A * 12/1976 Lang ..... 239/570
4,161,965 A * 7/1979 Merritt ..... 138/46
4,202,501 A * 5/1980 Haynes ..... 138/45
4,561,593 A * 12/1985 Cammack et al. ..... 239/590
4,614,303 A * 9/1986 Moseley et al. ..... 239/590.5
4,667,700 A * 5/1987 Buzzi ..... 138/45
5,634,491 A * 6/1997 Benedict ..... 137/504
6,705,549 B2 * 3/2004 Nakamura ..... 239/533.1

* cited by examiner

*Primary Examiner*—Steven J Ganey
(74) *Attorney, Agent, or Firm*—Pro-Techtor Int'l Services

(57) ABSTRACT

A control device for a shower head assembly includes is engaged with an inlet of the shower head and includes a tubular body which has a central piece located at a center thereof. A plurality of plates are connected between the central piece and an inner periphery of the tubular body. A flexible ring is mounted to the central piece such that a path is defined between the inner periphery of the tubular body and an outer periphery of the flexible ring. The flexible ring is expanded by water pressure to narrow the size of the path so that the maximum volume of the water can be controlled.

3 Claims, 6 Drawing Sheets

WATER VOLUME CONTROL DEVICE FOR SHOWER HEAD

FIELD OF THE INVENTION

The present invention relates to a water volume control device for shower head and the device changes the size of path through which the water passes when water pressure changes.

BACKGROUND OF THE INVENTION

A conventional shower head assembly is shown in FIG. 1 and generally includes a shower head 50 having a shower face with a plurality of holes at one end and an inlet 51 is defined in the other end of the shower head 50. A water control volume control device 40 is engaged with the inlet 51 and includes a restriction member 41 which includes several pawls to hold a mediate member 42 which includes three passages 421 and a cone-shaped tip, and a ring 43 is located at the opening of the inlet 51 to position the restriction member 41 and the mediate member 42. Water enters the inlet 51 and passes through the passages 421 and sprays from the shower face. The size of the passages 421 is not adjustable so that the water volume passing through the passages 421 are varied when the water pressure changes.

The present invention intends to provide a water volume control device which changes the size of the path according to the water pressure so as to control the net water volume of the shower head less than 2.5 gallon per minute.

SUMMARY OF THE INVENTION

The present invention relates to a shower head assembly which comprises a shower head having a shower face at a first end thereof and an inlet defined in a second end of the shower head. A control device is engaged with the inlet and includes a tubular body which has a central piece located at a center thereof, and a plurality of plates are connected between the central piece and an inner periphery of the tubular body. The central piece includes an enlarged head and a flange extends radially outward from an outer periphery of the central piece. A flexible ring is engaged with a space defined between the enlarged head and the flange so as to define a path between the inner periphery of the tubular body and an outer periphery of the flexible ring which is expanded by water pressure.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
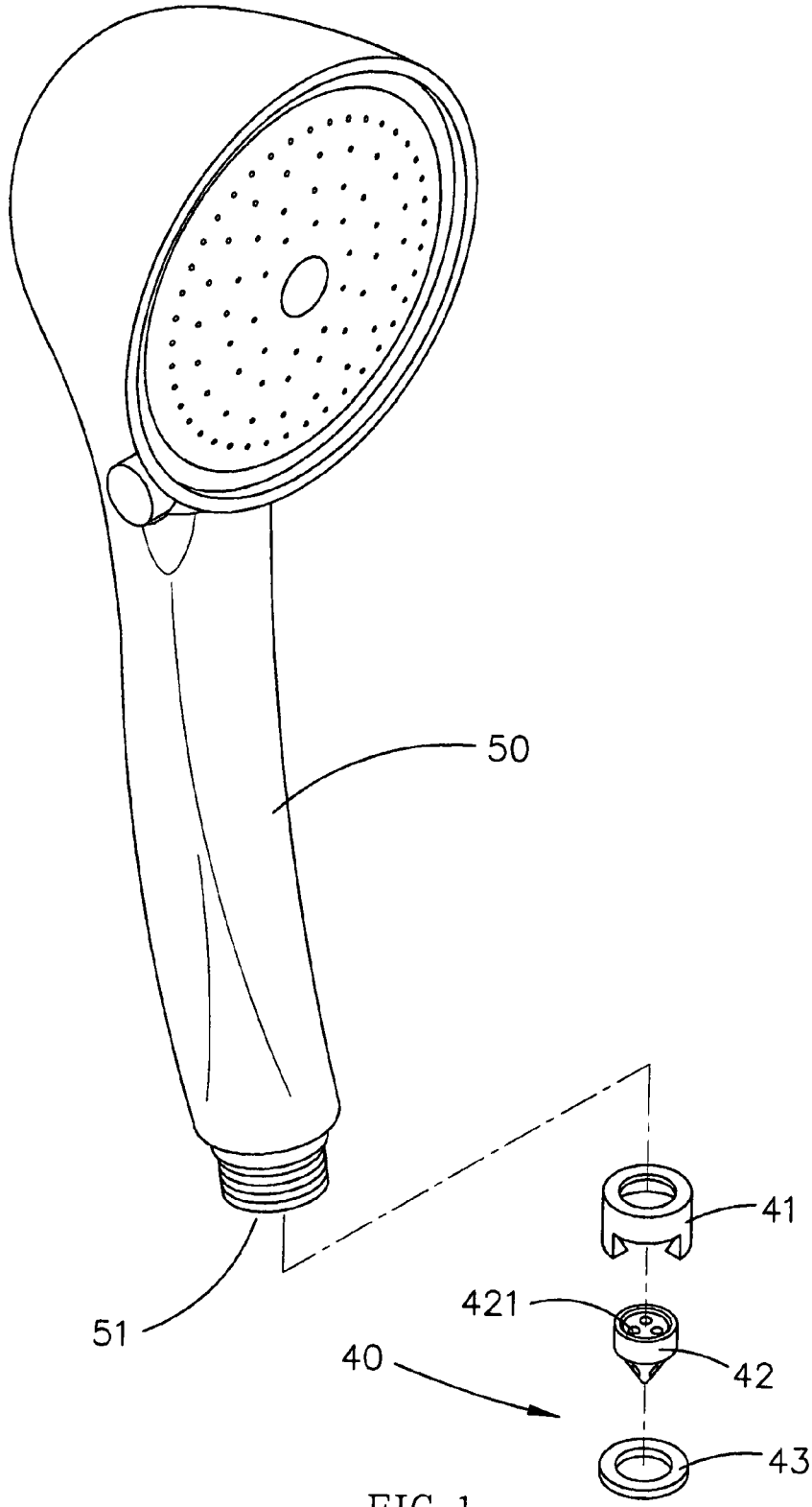
FIG.1 PRIOR ART
FIG. 1 is an exploded view to show a conventional shower head assembly.
Figure 2:
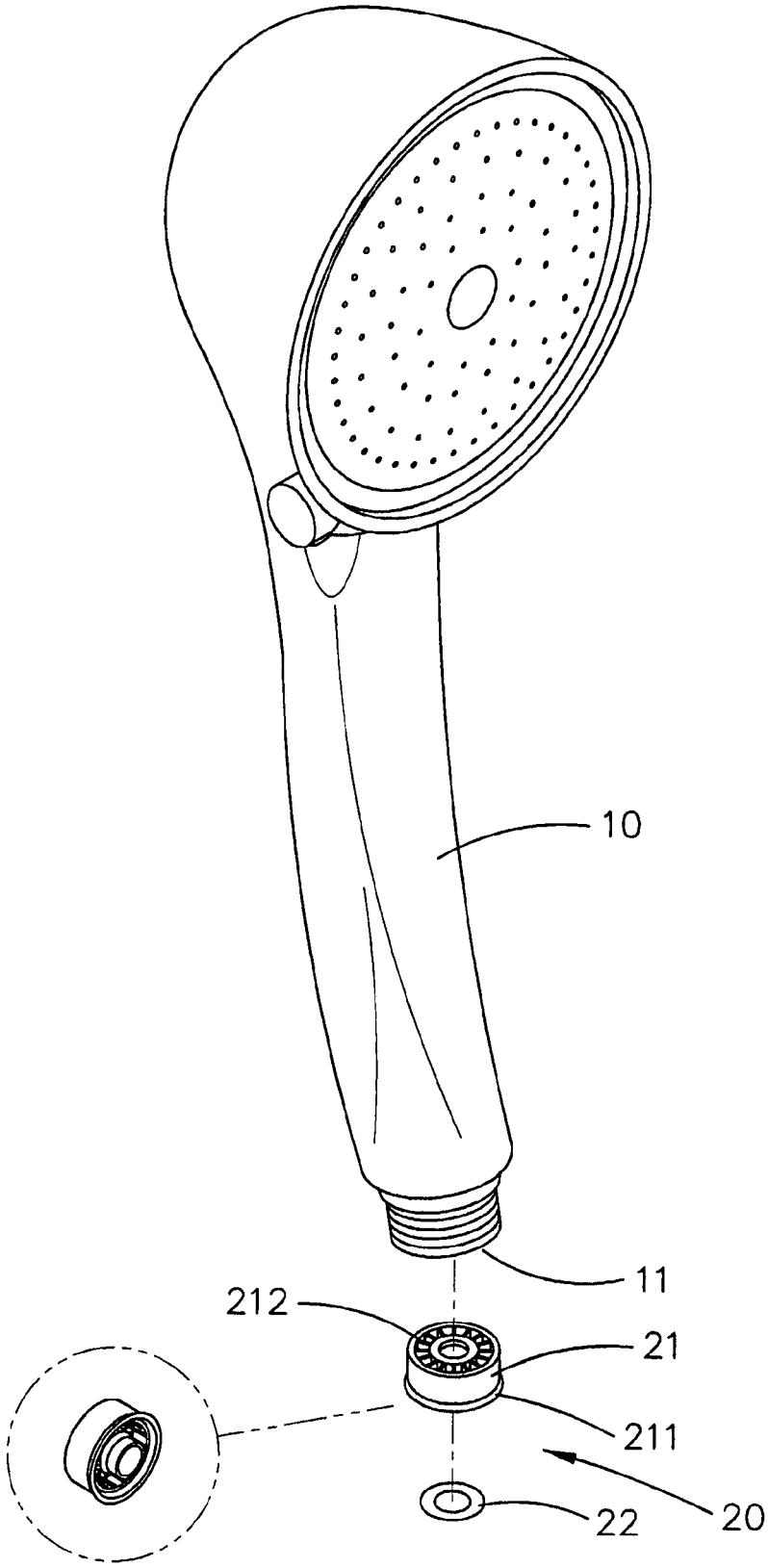
FIG. 2 is an exploded view to show the shower head assembly of the present invention.
Figure 3:
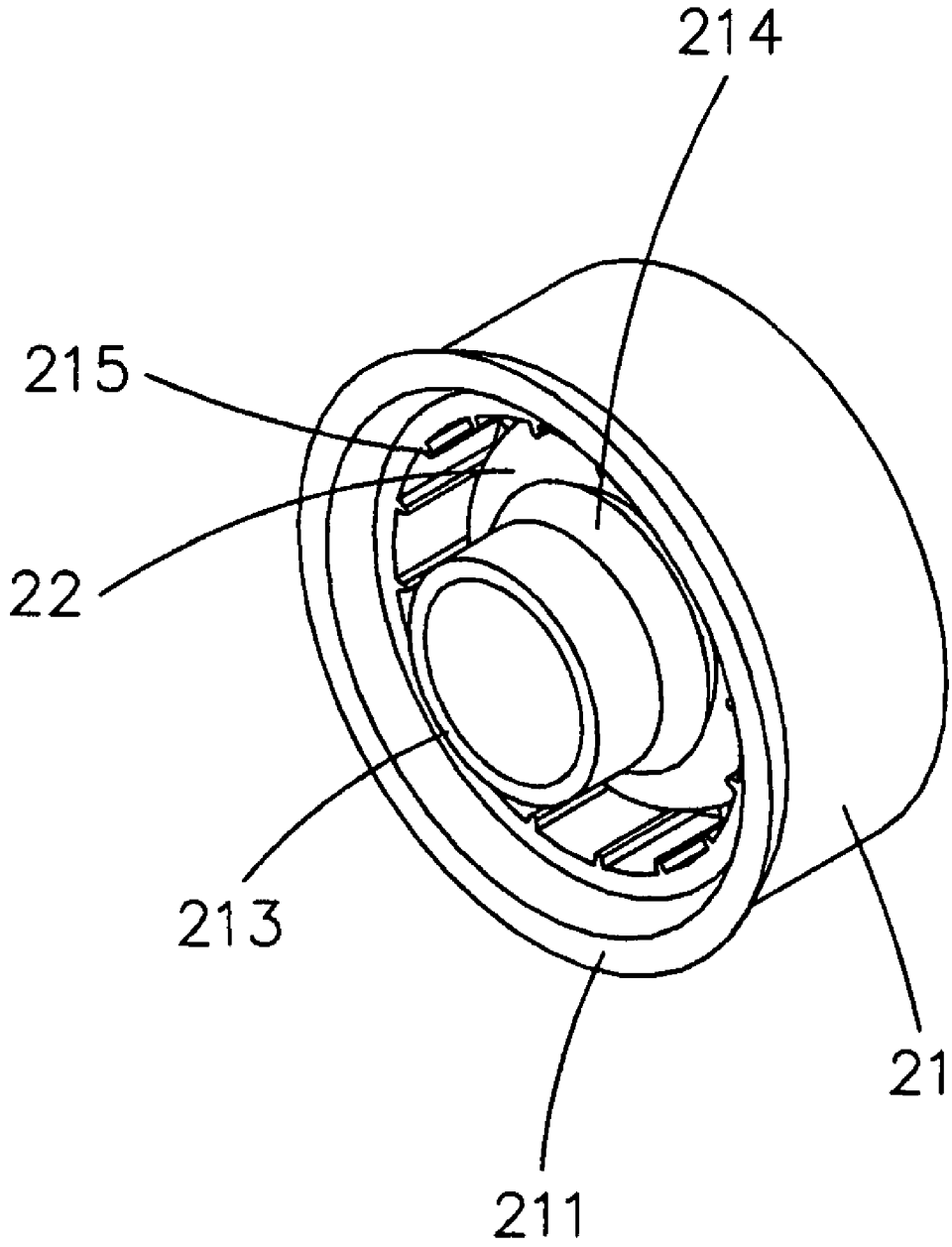
FIG. 3 is a perspective view to show the control device of the present invention.
Figure 4:
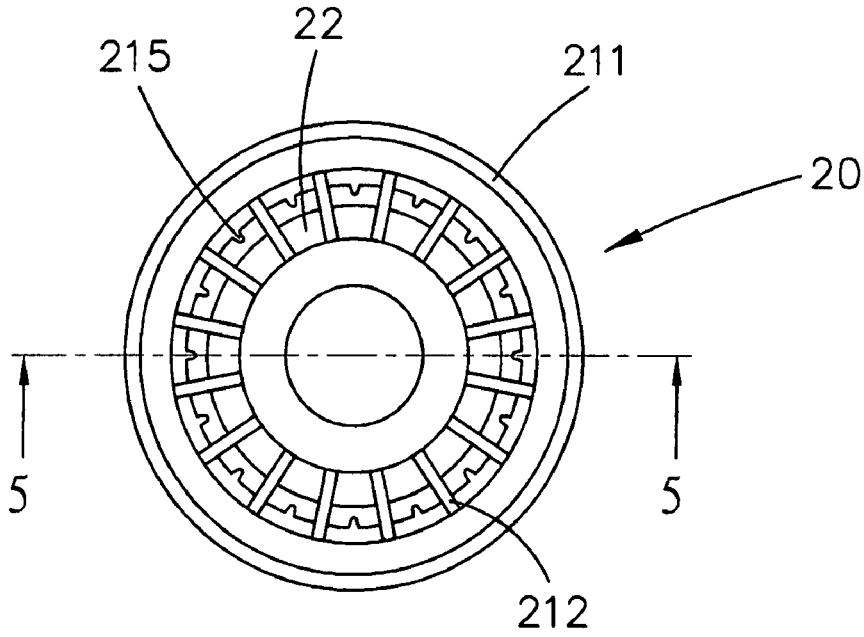
FIG. 4 is a top view to show the control device of the present invention.
Figure 5:
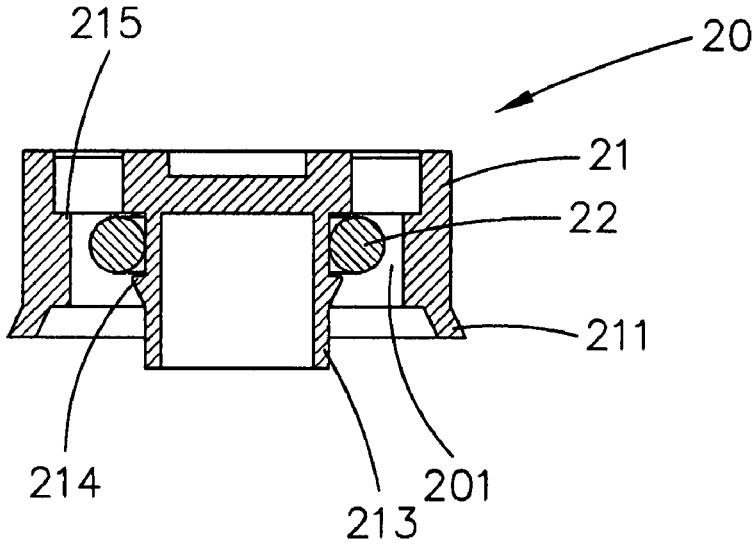
FIG. 5 is a cross sectional view of the control device of the present invention.
Figure 6:
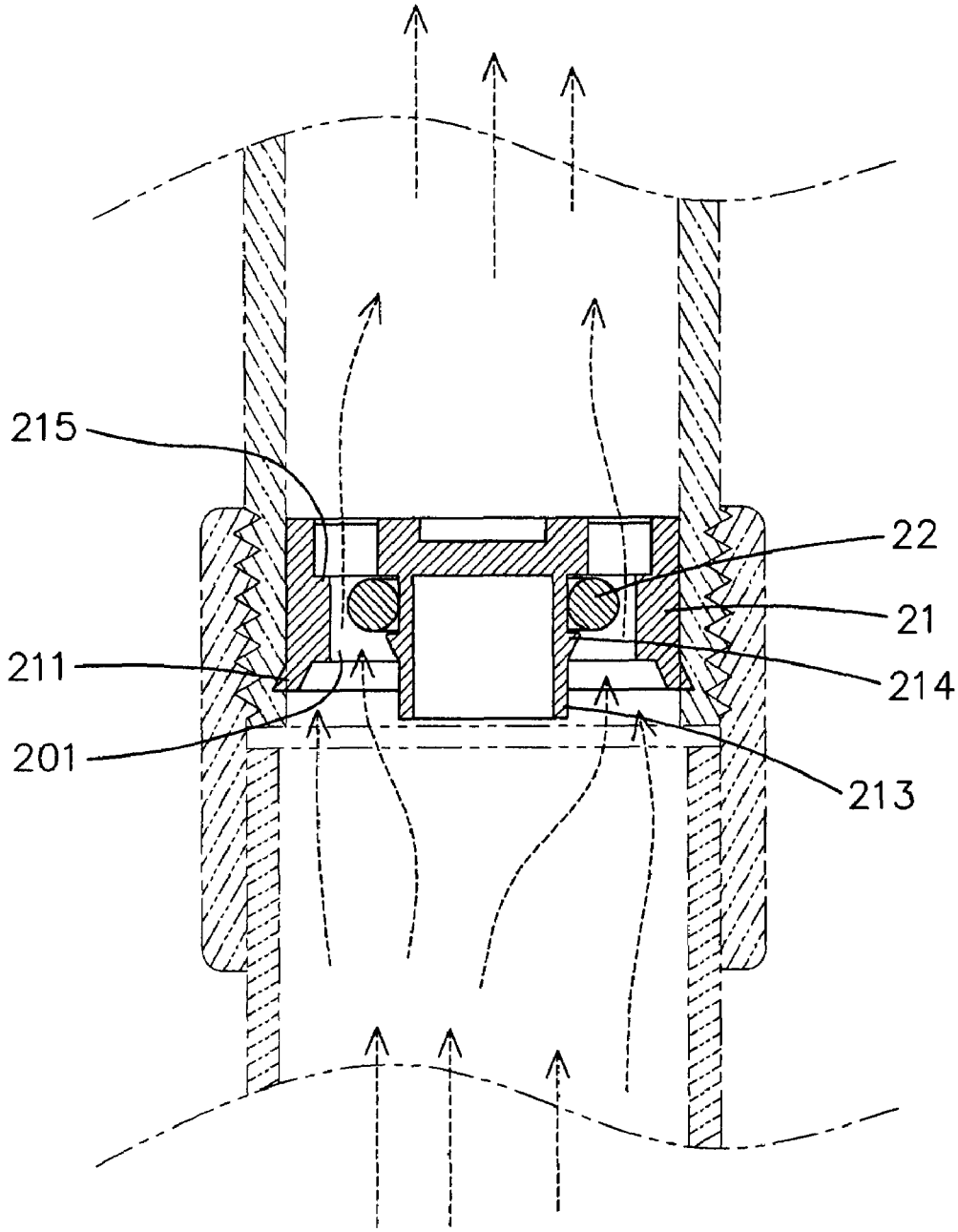
FIG. 6 is a cross sectional view to show the water passes through the path in the control device of the present invention.
Figure 7:
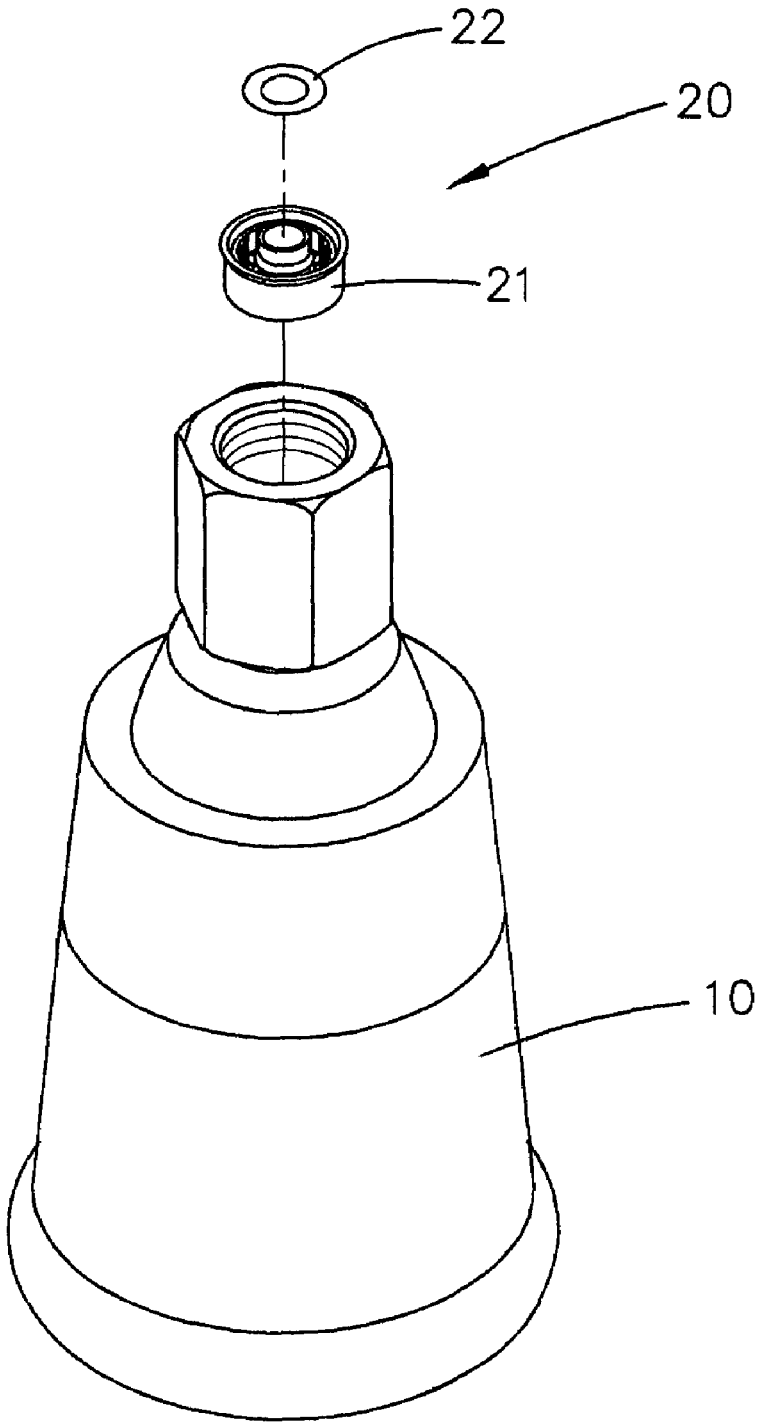
FIG. 7 is an exploded view to show a stationary shower head and the control device of the present invention.

Referring to FIGS. 2 to 7, the shower head assembly of the present invention comprises a shower head 10 having a shower face at a first end thereof and an inlet 11 defined in a second end of the shower head 10.

A control device 20 is engaged with the inlet 11 and includes a tubular body 21 which has a central piece 213 located at a center thereof, and a plurality of plates 212 connected between the central piece 213 and an inner periphery of the tubular body 21. The central piece 213 includes an enlarged head at a first end thereof and a flange 214 extends radially outward from an outer periphery of the central piece 213. A flexible ring 22 is engaged with a space defined between the enlarged head and the flange 214. A plurality of longitudinal ribs 215 extend inward from the inner periphery of the tubular body 21 and are located corresponding to the flexible ring 22. A path 201 is defined between the inner periphery of the tubular body 21 and an outer periphery of the flexible ring 22. An engaging flange 211 extends radially outward from a second end of the tubular body 21 so as to be engaged with an inner periphery of the inlet 11.

When the water pressure is in a normal range, the flexible ring 22 does not expand so that the size of the path 201 is remained the same. When the water pressure is too high, the flexible ring 22 is expanded by water pressure so as to narrow the path 201 such that the water volume passing through the path 201 can be controlled.

The control device 20 can also be used to a stationary shower head 10 as shown in FIG. 8.

While we have shown and described the embodiment in accordance with the present invention, it should be clear to those skilled in the art that further embodiments may be made without departing from the scope of the present invention.

What is claimed is:

1. A shower head assembly comprising:

a shower head having a shower face at a first end thereof and an inlet defined in a second end of the shower head;

a control device engaged with the inlet and including a tubular body which has a central piece located at a center thereof, a plurality of plates connected between the central piece and an inner periphery of the tubular body, the central piece including an enlarged head and a flange extending radially outward from an outer periphery of the central piece, a flexible ring engaged with a space defined between the enlarged head and the flange, a path defined between the inner periphery of the tubular body and an outer periphery of the flexible ring which is adapted to be expanded by water pressure.

2. The shower head assembly as claimed in claim 1, wherein a plurality of longitudinal ribs extend inward from the inner periphery of the tubular body and are located corresponding to the flexible ring.

3. The shower head assembly as claimed in claim 1, wherein an engaging flange extends radially outward from an end of the tubular body.

* * * * *